US009644429B2

(12) United States Patent
Mensa-Wilmot

(10) Patent No.: US 9,644,429 B2
(45) Date of Patent: May 9, 2017

(54) SPECIALIZED BIT FOR CHALLENGING DRILLING ENVIRONMENTS

(71) Applicant: Graham Mensa-Wilmot, Spring, TX (US)

(72) Inventor: Graham Mensa-Wilmot, Spring, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 443 days.

(21) Appl. No.: 14/231,834

(22) Filed: Apr. 1, 2014

(65) Prior Publication Data

US 2015/0275584 A1 Oct. 1, 2015

(51) Int. Cl.

| | |
|---|---|
| ***E21B 10/43*** | (2006.01) |
| ***E21B 10/55*** | (2006.01) |
| ***E21B 10/567*** | (2006.01) |
| ***E21B 10/42*** | (2006.01) |

(52) U.S. Cl.

CPC ..... *E21B 10/43* (2013.01); *E21B 10/55* (2013.01); *E21B 10/5673* (2013.01); *E21B 2010/425* (2013.01)

(58) Field of Classification Search

CPC ..... E21B 10/43; E21B 10/55; E21B 10/5673; E21B 10/425; E21B 10/46; E21B 10/545; E21B 10/567; E21B 10/56; E21B 10/54; E21B 10/42; E21B 10/00; E21B 10/36

See application file for complete search history.

(56) References Cited

U.S. PATENT DOCUMENTS

| | | | | |
|---|---|---|---|---|
| 5,549,171 | A * | 8/1996 | Mensa-Wilmot | E21B 10/43 175/431 |
| 5,551,522 | A | 9/1996 | Keith | |
| 5,607,024 | A | 3/1997 | Keith et al. | |
| 2007/0240905 | A1 | 10/2007 | Mensa-Wilmot | |
| 2011/0073369 | A1 | 3/2011 | Vempati | |

OTHER PUBLICATIONS

International Search Report and Written Opinion of the International Searching Authority for International application No. PCT/US2015/018984 dated Jun. 22, 2015, 12 pages.

* cited by examiner

*Primary Examiner* — Wei Wang
(74) *Attorney, Agent, or Firm* — Parul P. Anderson

(57) ABSTRACT

The present disclosure provides a drill bit having cutters of different geometries, such as the combination of round cutters and scribe cutters. The drill bit includes at least one radial location at which both a round cutter and a scribe cutter are disposed. Thus, the drill bit leverages the high cutting efficiency of the scribe cutter as well as the high impact resistance of the round cutter. Additionally, the round cutter and the scribe cutter have the same maximum distance from the drill bit. Thus, the round cutter and the scribe cutter which share the same radial location contact the rock formation at substantially the same time when used in a drilling operation.

12 Claims, 5 Drawing Sheets

SPECIALIZED BIT FOR CHALLENGING DRILLING ENVIRONMENTS

TECHNICAL FIELD

The present application relates to drill bits. Specifically, the present application relates to a specialized drill bit design with increased efficiency for drilling in harsh and complex environments.

BACKGROUND

Current drill bits usually work well in applications or drilling environments where a single formation or rock type (e.g., salt, sediment, carbonate) is encountered in the interval or hole size to be drilled. However, some applications or down-hole environments have layers or zones of different formation and lithology types in the same interval or hole size. For example, a down-hole environment may have a first layer of salt and a second layer of sediment in the same interval. In order to drill through a zone comprising layers of different rock types, the drill bit, bottom hole assembly, and/or other parts of the drill string may need to be changed when transitioning between the different layers or zones, as the different rock types may require different drilling parameters that may not currently be accommodated by the same drill bit. For example, when drilling in a zone having a salt layer and a sediment layer, one type of drill bit may be needed to drill through the salt layer and a different type of drill bit may be needed to drill through the sediment layer. In order to change the drill bit or other parts of the drill string amid an operation, the drill string and bottom hole assembly (BHA) must be tripped thus taken out of the hole and, then run back into the hole after the tool(s) are changed. Variations in the type, hardness and abrasiveness of the rock layers can further increase the complexity of the drilling operation, with compromising effects on drilling process efficiency and overall project costs. Typically, the more complex the drill zone, the more frequently the drill string will need to be tripped. Tripping, when unplanned, is a costly procedure which is to be minimized.

As an additional challenge, bottom hole assembly (BHA) components have operational time limitations, which also tend to be influenced by dynamic conditions. This characterization is usually quantified and expressed on a time scale as mean time between failures (MTBF). During a drilling operation, it may be advantageous to trip the drill string and change or recondition the equipment before the mean time between failure is reached, thereby decreasing the likelihood that the equipment will fail during the operation when the tools and equipment are downhole. Thus, it is desirable to drill through the required interval before the mean time between failure runs out. However, and as an example, if a drill bit does not exhibit appropriate durability and stability characteristics, to facilitate achievement of high enough rate of penetration (ROP), especially in the layered formations described, to drill through the required interval, before MTBF limitations are reached, the drill string will need to be tripped.

SUMMARY

In general, in one aspect, the disclosure relates to a drill bit for complex rock formations or environments. The drill bit can comprise at least two blades wherein the first blade has a first cutter of a first geometry and the second blade has a second cutter of a second geometry different from the first geometry. The first cutter and the second cutter are disposed at the same radial distance from a center of the drill bit, but at different locations on the drill bit. Furthermore, the point on the first cutter furthest from the drill bit body is at the same radial distance from the center of the drill bit as the point on the second cutter furthest from the drill bit body.

In another aspect, the disclosure can generally relate to a drill bit comprising a first blade with a first cutter having a scribe shape and a second blade with a second cutter have a round shape. The first cutter and the second cutter are disposed at different locations on the drill bit, but at the same radial distance from the center of the drill bit.

In another aspect, the disclosure can generally relate to a drill bit comprising at least two blades wherein the first blade has a first cutter of a first geometry and the second blade has a second cutter of a second geometry different from the first geometry. The first cutter and the second cutter are disposed at the same radial distance from a center of the drill bit, but at different locations on the drill bit.

These and other aspects, objects, features, and embodiments will be apparent from the following description and the appended claims.

BRIEF DESCRIPTION OF THE DRAWINGS

The drawings illustrate only example embodiments of a specialized drill bit for challenging environments, and are therefore not to be considered limiting of its scope, as the disclosures herein for the specialized drill bit may admit to other equally effective embodiments. The elements and features shown in the drawings are not necessarily to scale, emphasis instead being placed upon clearly illustrating the principles of the example embodiments. Additionally, certain dimensions or positioning may be exaggerated to help visually convey such principles. In the drawings, reference numerals designate like or corresponding, but not necessarily identical, elements. In one or more embodiments, one or more of the features shown in each of the figures may be omitted, added, repeated, and/or substituted. Accordingly, embodiments of the present disclosure should not be limited to the specific arrangements of components shown in these figures.

DETAILED DESCRIPTION OF EXAMPLE EMBODIMENTS

Figure 1:
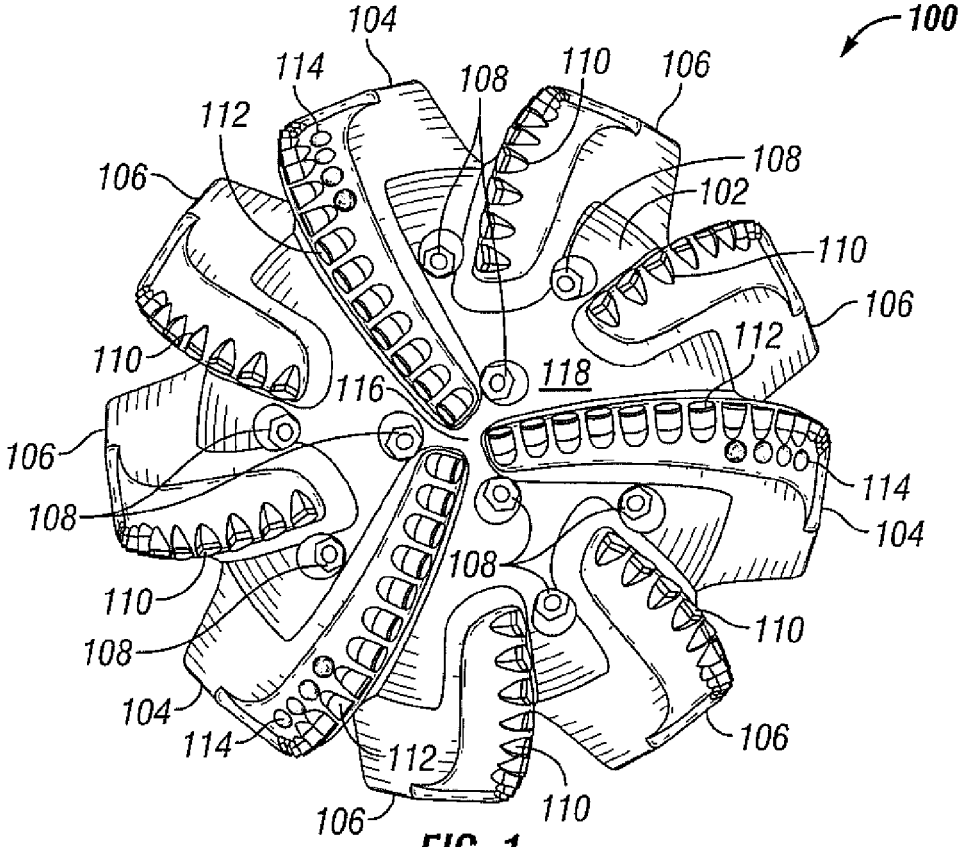
FIG. 1 illustrates a top view of a specialized drill bit for drilling in challenging environments, in accordance with example embodiments of the present disclosure.

Example embodiments directed to specialized bits for challenging environments will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments disclosed herein may be practiced without these specific details. In other instances, well-known features have not been described in detail to avoid unnecessarily complicating the description. Designations such as "first" and "second" are merely used to distinguish between distinct features, and are not meant to limit the number of features. Furthermore, in certain embodiments, such distinct features are not precluded from having the same value or identical physical attributes, if applicable. Descriptions such as "top", "above", "bottom", "below', "distal", "proximal", and the like are merely used to distinguish between different portions of an element or relative positioning between elements and are not meant to imply an absolute orientation.

Figure 2:
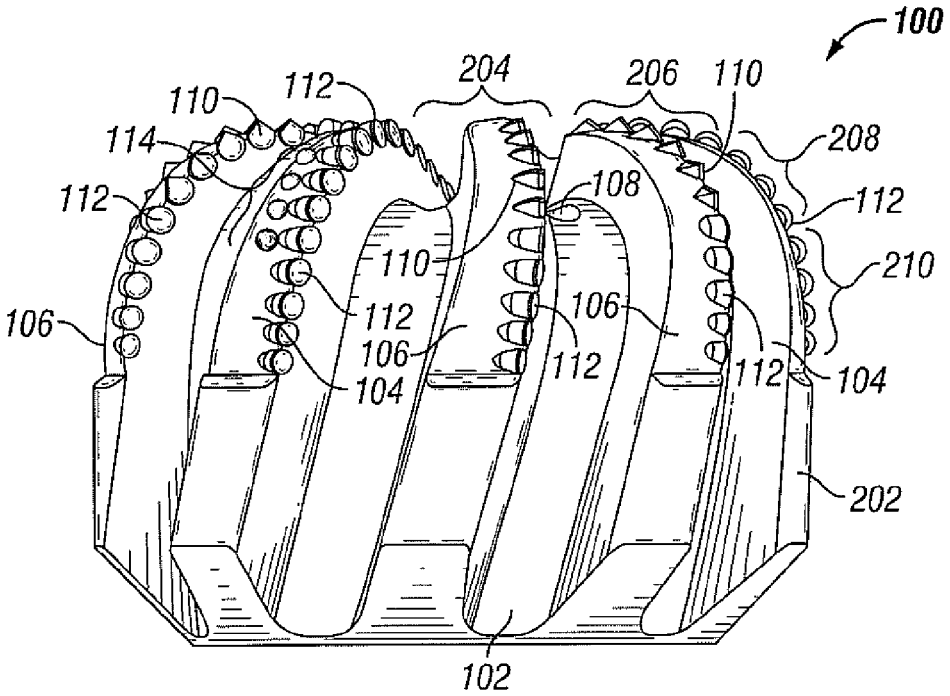
FIG. 2 illustrates a side view of the drill bit of FIG. 1, in accordance with example embodiments of the present disclosure.
Figure 3:
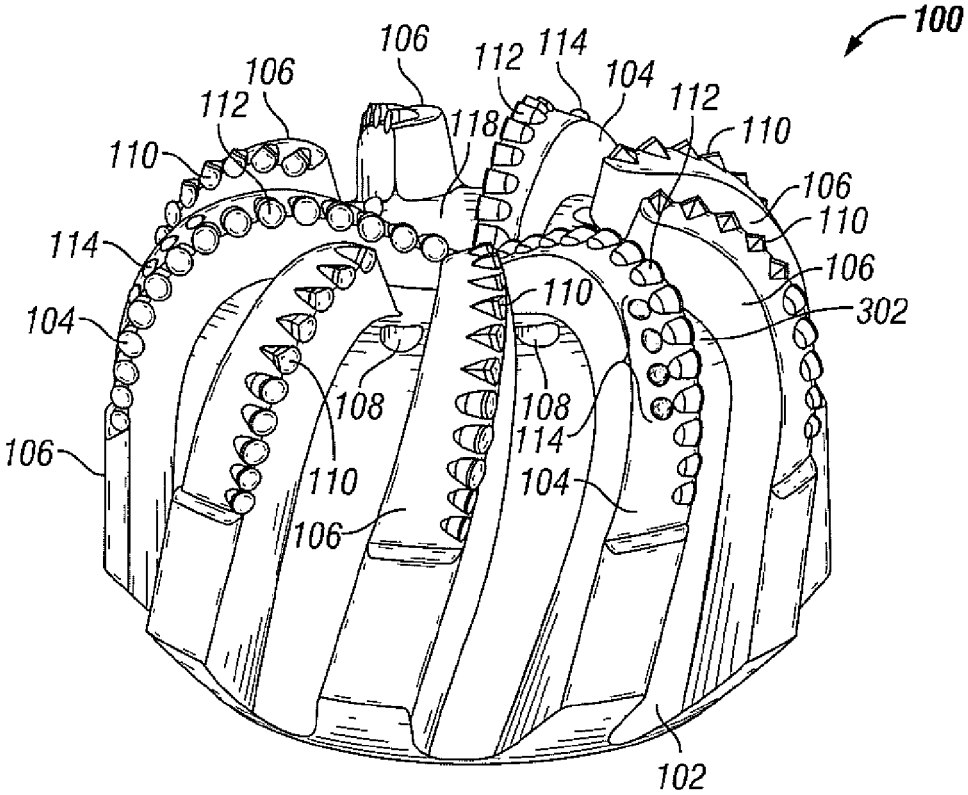
FIG. 3 illustrates a perspective view of the drill bit of FIGS. 1 and 2, in accordance with example embodiments of the present disclosure.

Referring now to the drawings, FIG. 1 illustrates a top view of a specialized drill bit 100 for challenging environments, in accordance with certain example embodiments of the present disclosure. FIG. 2 illustrates a side view of the drill bit 100 of FIG. 1, and FIG. 3 illustrates a perspective view of the drill bit of FIGS. 1 and 2, in accordance with example embodiments of the present disclosure. Referring to FIGS. 1, 2, and 3, the drill bit 100 includes a bit body 102, one or more primary blades 104, one or more secondary blades 106, and one or more nozzles 108. The drill bit 100 can also be divided into four regions, as best seen in FIG. 2. The four regions include a cone region 204, a nose region 206, a shoulder region 208, and a gauge region 210. The drill bit 100 also includes gauge pads 202 located near the bottom of the drill bit adjacent the gauge region 210. In certain example embodiments, the primary blades 104 run along a portion of the profile of the bit body 102, from the gauge pads 202 of the bit body 102 and through the gauge 210, shoulder 208, nose 206, and cone 204. In certain example embodiments, the primary blades 104 taper in width as they get closer to the cone 204. In certain example embodiments, such as that illustrated in FIGS. 1, 2, and 3, each of the primary blades 104 includes a plurality of round cutters 112 disposed along an edge of each of the primary blades 104. Specifically, in certain example embodiments, on each primary blade 104, the plurality of round cutters 112 are disposed substantially adjacent each other along the primary blade 104. In the illustrated example of FIGS. 1, 2, and 3, the drill bit 100 includes three primary blades 104 positioned radially symmetrically around the bit body 102. In other embodiments, and based on the bit's total blade count, the placement of the primary blades may not be symmetrical.

In certain example embodiments, the secondary blades 106 are disposed along a portion of the profile of the bit body 102, and extend from the gauge pads 202 though the gauge 210, the shoulder 208, and the nose 206. In certain example embodiments, the secondary blades 106 are shorter than the primary blades 104 and terminate before reaching the cone 204. In certain example embodiments, such as that illustrated in FIGS. 1, 2, and 3, each of the secondary blades 106 includes a plurality of scribe cutters 110 and another plurality of round cutters 112. In the illustrated embodiment, the plurality of scribe cutters 110 are disposed on a portion of the secondary blade 106 on the nose 206 and the shoulder 208, and the plurality of round cutters 112 are disposed on a portion of the secondary blade 106 on the gauge 210. In an example embodiment, the plurality of scribe cutters 110 and round cutters 112 are disposed substantially adjacent each other along an edge of the respective secondary blade 106. In certain example embodiments, the round cutters 112 of the primary blades 104 and the scribe and round cutters 110, 112 of the secondary blades 106 face the same direction relative to the blade 104, 106 on which the cutter 110, 112 is disposed. Specifically, as illustrated in FIG. 1, the cutters 110, 112 face counter-clockwise with respect to the bit body 102. In the illustrated embodiment of FIGS. 1, 2, and 3, the drill bit 100 includes six secondary blades 106 with two secondary blades 106 disposed equally between the three primary blades 104. In other example embodiments, the drill bit 100 may include more or less than three primary blades 104 and six secondary blades 106, and the blades 104, 106 may be positioned in a configuration different than that illustrated herein.

Figure 4A:
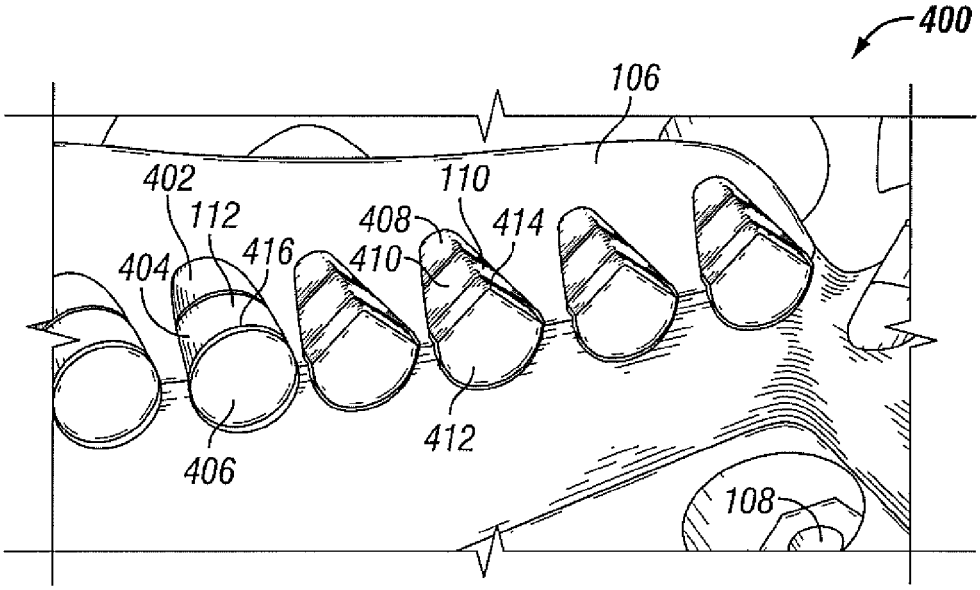
FIGS. 4A, 4B and 4C illustrate detailed views of a blade of the drill bit of FIG. 1, in accordance with example embodiments of the present disclosure.
Figure 4B:
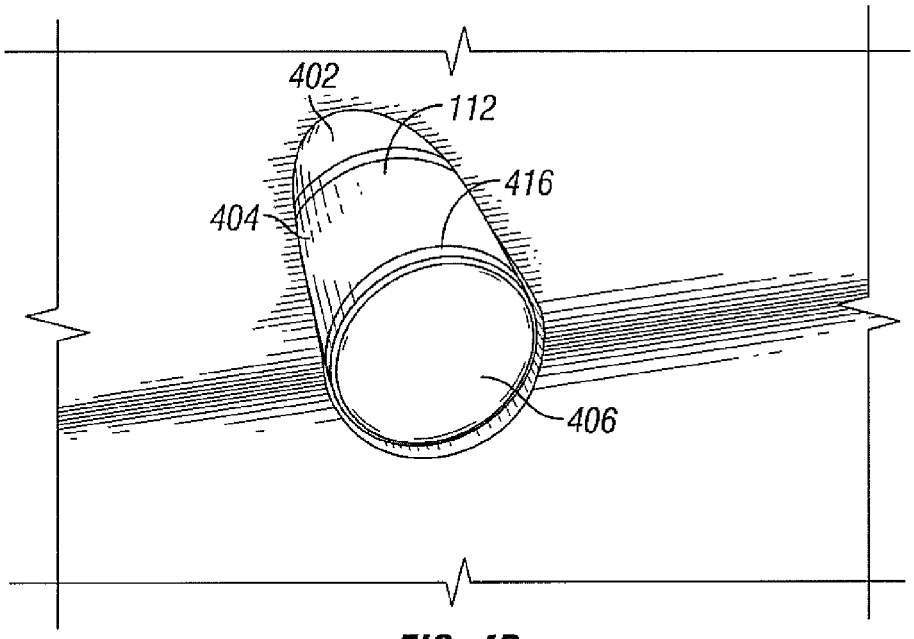
Figure 4C:
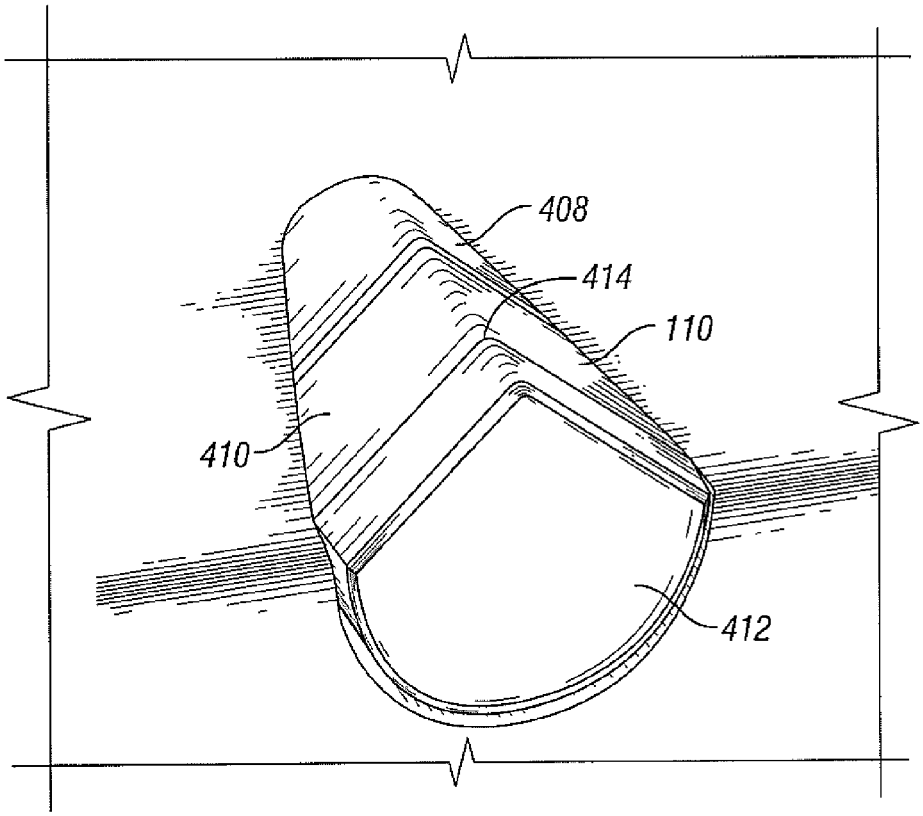

FIGS. 4A, 4B and 4C illustrate detailed views of a blade 400 in accordance with example embodiments of the present disclosure. Referring to FIG. 4A, the blade 400 includes a plurality of round cutter holders 402 and a plurality of scribe cutter holders 408 formed within the blade 400. The round cutter 112, shown in FIGS. 4A and 4B, includes a substrate 404 or cutter base and a diamond table 406. The round cutter 112 includes at least a curved surface 416 facing outwardly from the bit body 102. In certain example embodiments, the substrate 404 is fabricated from tungsten carbide and the diamond table 406 is fabricated from polycrystalline diamond. The round cutter 112 is bonded into the round cutter holder 402 through a bonding process such as brazing. The round cutter holder 402 has a shape complimentary to the shape and profile of the round cutter 112. The diamond table 406 provides a hard cutting surface which cuts through the rock formation. Likewise, the scribe cutter 110, shown in FIGS. 4A and 4C, also includes a substrate 410 and a diamond table 412. The scribe cutter 110 includes at least a substantially pointed tip 414 directed outwardly from the bit body 102. In certain embodiments, the pointed tip 414 may have a small curvature. The scribe cutter 110 is also bonded into the scribe cutter holder 408 through a bonding process such as brazing. The shape of the scribe cutter holder 408 has a shape complimentary to the shape and profile of the scribe cutter 110.

The material used in fabricating the diamond tables 406, 412 can be chosen according to the desired abrasion properties and impact properties. These properties are at least partially determined by the grain size of the diamond material used. For example, if the diamond material is coarse (e.g., 60-80 microns), it generally has better impact resistance than finer diamond material. Conversely, the finer the grain size of the diamond material, the greater the abrasion resistance of the diamond material. In certain example embodiments, all the cutters 112, 110 on the drill bit 100 have diamond tables 406, 412 fabricated from the same diamond material and thus have the same diamond properties. In certain other example embodiments, the round cutters 112 have diamond tables 406 fabricated from a first diamond material and the scribe cutters 110 have diamond tables 412 fabricated from a second diamond material, in which the first diamond material has different diamond properties than the second diamond material. Additionally, in certain example embodiments, the diamond tables 406 of the plurality of round cutters 112 on the drill bit 100 are fabricated from different diamond materials having different diamond properties. For example, a round cutter 112 located on the gauge 210 of the drill bit 100 may have a diamond table 406 fabricated from a different diamond material than the diamond table 406 of a round cutter 112 located on the cone 204 of the drill bit. The diamond materials used with respect to each of the cutters 112, 110 can be chosen based on the physical design of the drill bit 100, properties of the rock formation in the drill zone, other aspects of the bottom hole assembly and/or drilling environment, and the desired drilling parameters and results.

Figure 5:
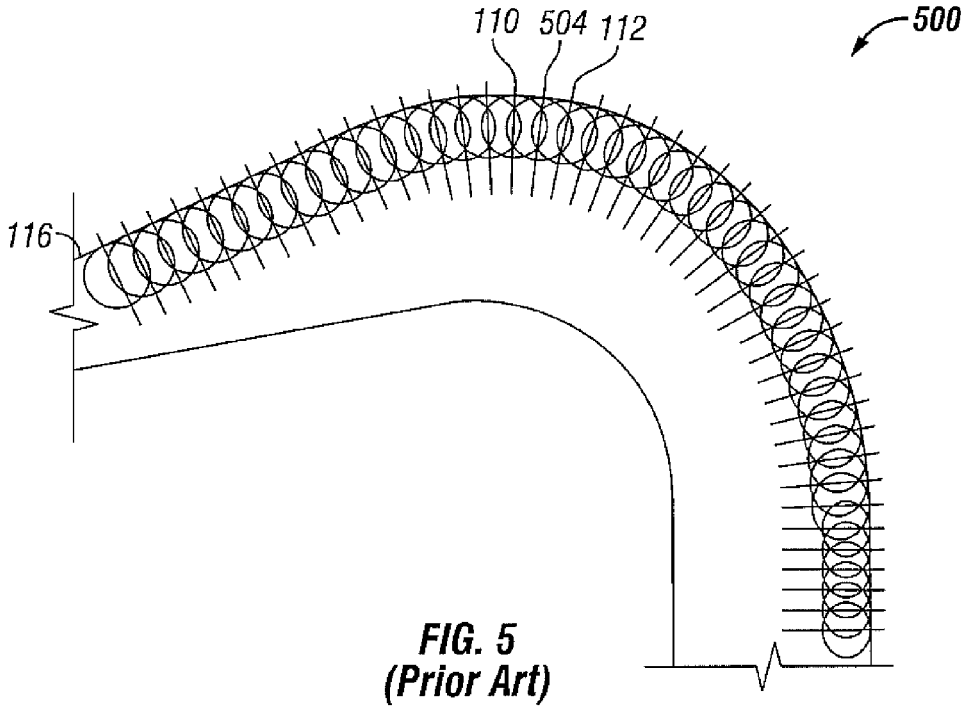
FIG. 5 (Prior Art)
FIG. 5 illustrates a profile view of a prior art drill bit, when cutting elements on all the blades have been rotated onto the same radial plane.

FIG. 5 illustrates a profile view 500 of a prior art drill bit in which all the blades have been rotated onto the same radial plane to illustrate the overlap of the cutters on each blade. All of the cutters disposed around the drill bit have a single common geometry for the prior art drill bit illustrated in FIG. 5. In other words, for a particular radial location 504 from the center of the drill bit, all cutters positioned around the drill bit at that radial location 504 have the same geometry. The prior art drill bit illustrated in FIG. 5 experiences the challenges and limitations discussed in the Background section above, particularly in intervals or hole sizes with layers or zones of different formations.

Figure 7:
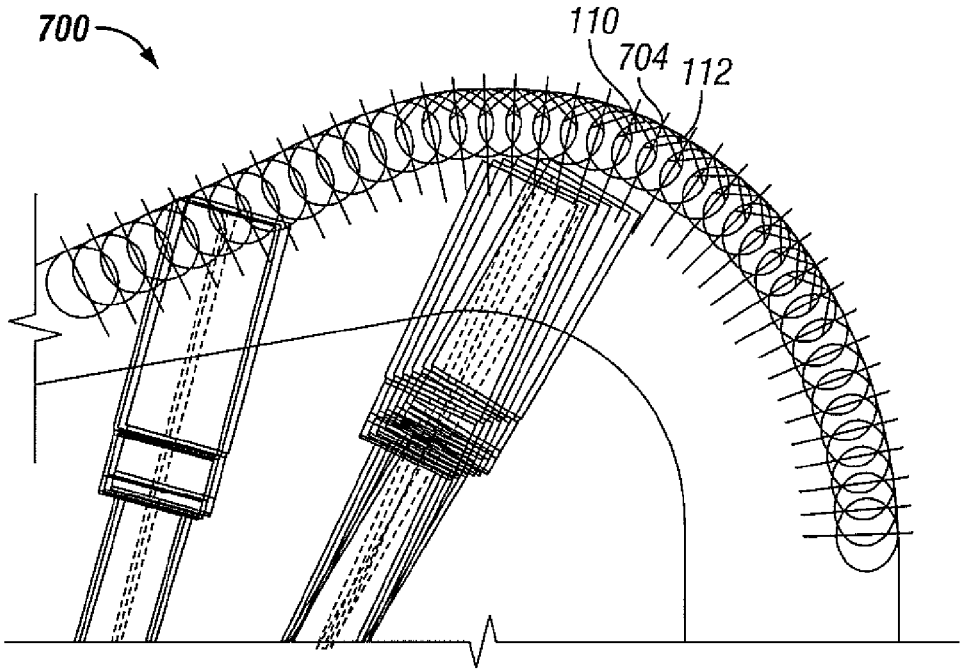
FIG. 7 illustrates a profile view of the drill bit of FIG. 1 in which all the blades have been rotated onto the same radial plane, in accordance with example embodiments of the present disclosure.

FIG. 7 illustrates a profile view 700 of a portion of the drill bit 100 in which all the blades 104, 106 have been rotated onto the same radial plane, in accordance with an example embodiment of the present disclosure. More specifically, the radial locations of the cutters 110, 112 of all the blades 104, 106 can be seen collectively and in relation to each other, regardless of the circular position of the cutters 110, 112. Referring to FIGS. 1 and 7, in certain example embodiments, the drill bit 100 comprises at least one radial distance, otherwise called a radial location, from the center 116 of the drill bit 100 at which both a scribe cutter 110 and a round cutter 112 are disposed and symmetrically overlapping. For example, according to the example embodiment of FIG. 1, a secondary blade 106 includes at least one scribe cutter 110 which is disposed at a first radial location 704 from the center 116 of the drill bit 100. In this embodiment, a primary blade 104 includes at least one round cutter 112 which is disposed at the same first radial location 704 from the center 116 of the drill bit 100. Though the round cutter 112 and the scribe cutter 110 are disposed at different physical locations around the drill bit 100, also called a circular location, the round cutter 112 and the scribe cutter 110 are said to have the same radial location because they are both positioned at the same distance from the center 116.

Figure 8A:
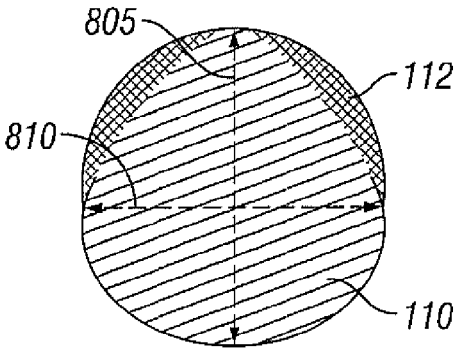
FIG. 8A illustrates the common axes of a scribe cutter and a round cutter in accordance with example embodiments of the present disclosure.
Figure 8B:
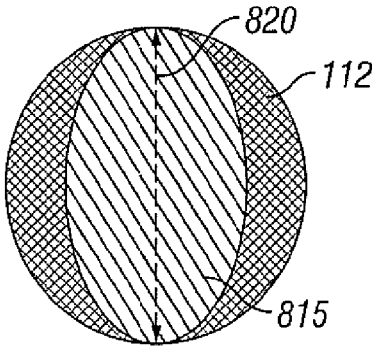
FIG. 8B illustrates the common axis of an oval cutter and a round cutter in accordance with example embodiments of the present disclosure.

Moreover, in certain example embodiments as described in further detail below in connection with FIGS. 8A and 8B, the round cutter 112 and scribe cutter 110 can share at least one common axis—that could be either a major or a minor axis, based on the geometries of the cutters or cutting elements. For example, where a round cutter and a scribe cutter are used as the cutting elements that share the common radial position, the two elements can share a common axis which is defined along a line that is perpendicular to the profile of the bit, in other words extending perpendicularly from the end of the bit. The two different cutting elements with a common radial location as described herein (round and scribe) may have their tips, measured along the perpendicular line to the bit profile, and furthest from the bit body in the same location or in different locations.

Additionally, in certain example embodiments, multiple round cutters 112 and multiple scribe cutters 110 are located at the same radial location. In certain example embodiments, the drill bit 100 includes multiple radial locations at which at least one round cutter 112 and at least one scribe 110 are disposed. The illustrated scribe cutters 110 and round cutters 112 are two example geometries. In certain example embodiments, the drill bit 100 includes cutters having geometries other than the scribe cutters 110 and the round cutter 112. These other geometries may include oval, elliptical, conical, rectangular, polygonal, curved, and the like. Thus, in certain example embodiments, the drill bit 100 includes at least one radial location at which a cutter of a first geometry and a cutter for a second geometry are both disposed. The special arrangement of the round and scribe cutters, considering the layout guidelines and conditions, presents several application benefits, in terms of drilling efficiency and stabilization, thus facilitating conditions where challenging and layered sections can be drilled faster before operational limitation times, in terms of MTBF are reached during the drilling process.

In an example embodiment, given the same applied weight on bit, scribe cutters 110 generally drill faster, or have greater cutting efficiency, than round cutters 112 when all other geometric parameters are kept constant. This is at least partially due to the pointed tip 414 of the scribe cutter 110, which allows the scribe cutters 112 to weaken and bite the rock more efficiently. Although round cutters 112 are typically less efficient when compared to scribe cutters, the round cutters 112 have greater impact resistance due to their curved surface 416. The curvature of the round cutters 112 provides a bigger region over which the loading resulting from the cutting action can be distributed, due to their comparatively lower curvature, thus distributing the load more evenly and experiencing less impact damage and wear. Scribe cutters 110, in addition to the more developed scallops they create on the bottom of the hole being drilled, also generate much higher restoration forces, in comparison to round cutters 112, due to their edge geometries, thus facilitating improved stabilization and promotion of true-center rotation for the drill bit.

Due to the shared common radial positions for the round cutters 112 and scribe cutters 110, as well as the differences in their peripheral geometries, and the condition of a common axis shared between the two geometries, diamond content varies across the periphery created by the two elements. Diamond content is highest in the region of the round cutter, that has 100% overlap with the scribe cutter (as illustrated in FIG. 8A discussed below). Consequently, and due to the diamond content differences, the round cutter in instances of abrasive wear is forced to assume the geometry of the scribe cutter. This time based wear configuration, forces the round cutter to assume the geometry of the scribe cutter, thus making it more efficient for harder and more brittle rock drilling which is usually encountered at depth. Without this predetermined pattern, the round cutter would have worn to a mechanically inefficient state, making it ineffective in harder and deeper rock drilling and thus forcing BHA trips to replace drilling tools (e.g. bits). The forced wear pattern on the round cutters also improves stabilization, due to an increase in the bit's restoration forces.

On the drill bit 100 provided by the present disclosure, round cutters 112 are combined with scribe cutters 110 so that they compensate for each other's weakness while providing their own advantages. Specifically, the drill bit 100 leverages the sharpness of the scribe cutters 110 to cut away at the rock with high efficiency as well as the curvature of the round cutters 112 to distribute and shoulder the load of the rock, which decreases the amount of load that the scribe cutters 110 would otherwise experience. Thus, the combination of the scribe cutters and round cutter at the same radial locations allows the drill bit 100 to achieve high cutting efficiency and improved stabilization, as well as high impact resistance. The unique placement of the round and scribe cutters eliminates weak zones across the bit's profile, even when the scribe cutters experience chipping, because the round cutters protect the specific radial locations.

In certain example embodiments, when a scribe cutter 110 and a round cutter 112 share the same radial location, the tip 414 of the scribe cutter 110 is aligned with a point on the circumference of the round cutter 112. Specifically, from a profile view perspective, such as that of FIG. 7, the geometry of scribe cutter 110 is substantially contained within the geometry of the round cutter 110. As shown in greater detail in FIG. 8A, the scribe cutter 110 and the round cutter 112 overlap with a minimum surface area overlap of the face of the cutter, also called the diamond tables, of 40% to 60%. In the example shown in FIG. 8A, the scriber cutter 110 and the round cutter 112 share a common vertical axis 805 and a common horizontal axis 810. The common axes of the two cutters ensure that the cutters not only overlap, but also ensure that a substantial portion of their respective surface areas overlap. In alternate embodiments, the two cutters having different geometries may only overlap along one axis. For example, FIG. 8B illustrates the overlap of a round cutter 112 and an oval cutter 815 located at the same radial position on an example drill bit. As shown in FIG. 8B, the round cutter 112 and the oval cutter 815 share a common vertical axis 820 and, from a profile perspective, the geometry of the oval cutter 815 fits within the geometry of the round cutter 112 such that the diamond table of the oval cutter 815 overlaps 60% of the surface area of the diamond table of the round cutter 112. In other embodiments, the two cutters having different geometries can be oriented in a variety of positions so that they overlap in pre-designed patterns to optimize the performance of the drill bit.

Additionally, in certain example embodiments, the geometry of the round cutter 112 is limited by the position of the tip 414 of the scribe cutter 110. Alternatively described, the point on the scribe cutter 110 furthest away from the bit body 102 is the same distance away from the bit body 102 as the point on the round cutter 112 furthest away from the bit body 112. The functional application of such an orientation of the scribe cutter 110 and the round cutter 112 is for the scribe cutter 110 and the round cutter 112 to make contact with the rock formation at substantially the same time. In certain example embodiments, the scribe cutter 110 and the round cutter 112 may have a slight difference in alignment than that described above. For example, in certain example embodiments, the tip 414 of the scribe cutter 110 may extend outside of the circumference of the round cutter 110, or the circumference of the round cutter 110 may extend beyond the tip 414 of the scribe cutter 110. In example embodiments in which the cutters of the drill bit 100 have other geometries, the geometries of the cutters sharing the same radial location extend substantially the same distance away from the bit body 102. Alternatively stated, cutters sharing the same radial location have substantially the same maximum distance from the bit body 102, provided a margin of difference as discussed above.

In certain example embodiments, the one or more nozzles 108 are disposed within the top surface 118 of the bit body 102. In certain example embodiments, the nozzles are sunken into the top surface 118 and are directed in various directions. Specifically, in certain example embodiments, the nozzles 108 are directed away from the center region 116. The nozzles 108 delivers drilling fluid from inside the drill string to the outside of the drill bit 100 to flush out drilling cuttings as the drill bit 100 cuts away at the rock formation. In certain example embodiments, the primary blades 104 include one or more depth of cut limiters 114. The depth of cut limiters 114 are raised portions disposed behind the round cutters 112 in order to prevent the cutter 112 from over-engaging the rock formation. In certain embodiments, the depth of cut limiters may be deployed behind the scribe or non-round cutters to serve the same purpose. The depth of cut limiters 114 prevent the cutters 112 from biting too deep into the rock formation, or past the exposure limit of the cutter 112. This prevents overloading on the cutters 112 In certain other example embodiments, the secondary blades 106 include one or more depth of cut limiters 114. In certain example embodiments, there may be depth of cut limiters 114 disposed behind scribe cutters. In some example embodiments, the depth of cut limiters 114 are not included.

Figure 6:
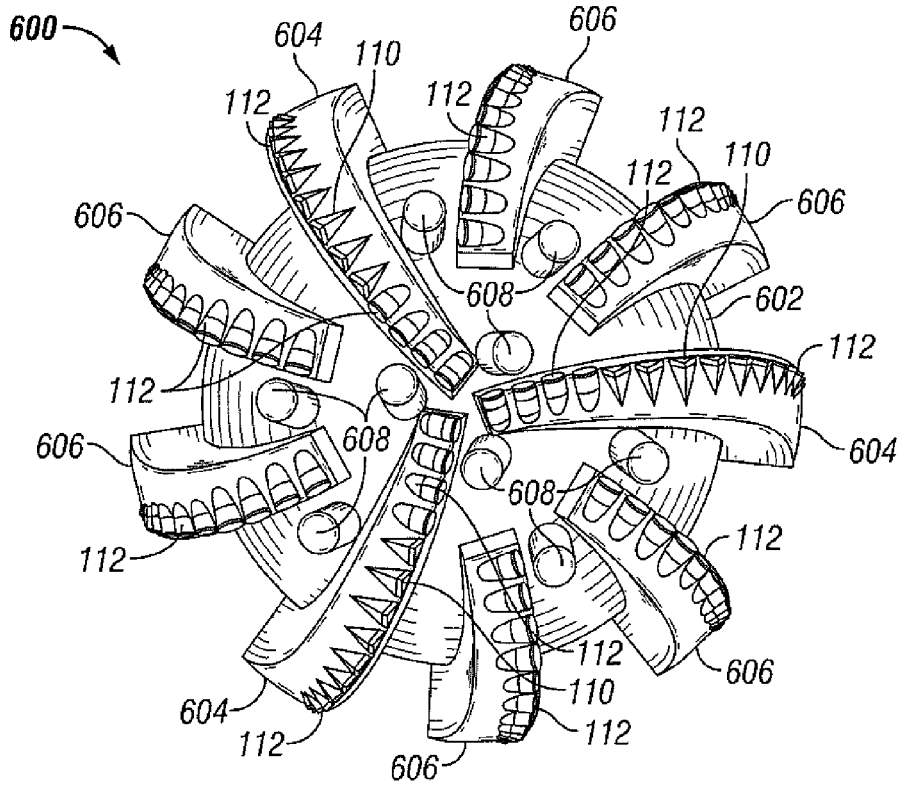
FIG. 6 illustrates another embodiment of a specialized drill bit, in accordance with example embodiments of the present disclosure.

FIG. 6 illustrates another embodiment of a specialized drill bit 600, in accordance with example embodiments. Similar to the drill bit 100 of FIG. 1, the drill bit 600 includes a bit body 102, a plurality of primary blades 604, a plurality of secondary blades 606, and a plurality of nozzles 608. In certain example embodiments, the primary blades 604 include a plurality of round cutters 112 as well as a plurality of scribe cutters 110. Specifically, the round cutters 112 are disposed on the primary blades 604 at the cone region 204 and also at the gauge region 210, while the scribe cutters 110 are disposed at the nose region 206 and the shoulder region 208. In certain example embodiments, the secondary blades 606 include all round cutters 112. As discussed with respect to the drill bit 100 of FIG. 1, the drill bit 600 also comprises at least one radial location at which both a scribe cutter 110 and a round cutter 112 are disposed.

The illustrated drill bits 100, 600 are two example embodiments of many drill bit configurations which are within the scope of the present disclosure. In certain example embodiments, the blades, whether primary, secondary, or other, can have any combination and positioning of scribe cutters 110 and round cutter 112, or cutters of other geometries. For example, one embodiment can have alternating scribe cutters 110 and round cutters 112 on a blade. In another example, each blade may only have one type of cutter. In certain example embodiments, only round cutter 112 may be disposed at the cone region 204. However, in other example embodiments, scribe cutters 110 are disposed at the cone region 204. In one example embodiments, the cone region 204 contains only round cutters 112, the nose region 206 and shoulder region 208 contain both round cutters 112 and scribe cutter 110, at least some of which share the same radial location, and the gauge region 210 includes only round cutters 112. In certain example embodiments, the orientation of scribe cutters 110 and round cutters 112 as well as the ratio of scribe cutters 110 to round cutters 112 are determined and chosen based on the desired drilling application, as well as the drilling performance expectations in terms of parameters and the type of drilling environment.

The combination of round cutters 112 and scribe cutters 110 at shared radial locations provides a drill bit having advantageous durability, stabilization, and cutting efficiency. This allows the drill bit to potentially drill through layers of different types of rock with minimal tripping, and to be a more robust and effective tool overall. Furthermore, the overall durability and cutting efficiency can be adjusted to meet the requirements of specific drill environment by adjusting the orientation or ratio of round cutters 112 and scribe cutters 110.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A drill bit, comprising:

a bit body comprising a surface center;

a first blade disposed on the bit body, the first blade comprising a first cutter of a first shape disposed on the first blade;

a second blade disposed on the bit body, the second blade comprising a second cutter of a second shape disposed on the second blade;

wherein a center of the first cutter is disposed at a first radial distance from the surface center of the bit body;

wherein a center of the second cutter is disposed at the first radial distance from the surface center of the bit body;

wherein the first and second cutters are disposed at different locations on the bit body;

wherein the point on the first cutter furthest away from the bit body is a tip of the first shape that is at a second radial distance from the surface center of the bit body;

wherein the point on the second cutter furthest away from the bit body is a tip of the second shape that is at the second radial distance from the surface center of the bit body, and wherein:

the tip of the first shape and the tip of the second shape are at a same distance from a surface of the bit body, and a height of the first cutter perpendicular to the surface of the bit body substantially corresponds to a height of the second cutter perpendicular to the surface of the bit body, and trajectories of the height of the first cutter and the height of the second cutter 100% overlap each other during rotary motion of the bit.

2. The drill bit of claim 1, wherein the first cutter comprises a first diamond table fabricated from a first diamond material and the second cutter comprises a second diamond table fabricated from a second diamond material, wherein the first diamond material and the second diamond material have different abrasion and/or impact properties.

3. The drill bit of claim 1, further comprising:

a cone region radially adjacent the surface center of the bit body;

a nose region radially adjacent the cone region;

a shoulder region radially adjacent the nose region; and a gauge region radially adjacent the shoulder region, wherein the first blade extends from and through the gauge region to and through the cone region.

4. The drill bit of claim 3, wherein the cone region comprises one or more cutters of the first geometry, the nose region comprises one or more cutters of the first geometry and one or more cutters of the second geometry, and the gauge region comprises one or more cutters of the first geometry.

5. The drill bit of claim 1, wherein the first blade further comprises at least one cutter of the second geometry.

6. A drill bit, comprising:

a bit body comprising a surface center;

a first blade disposed on the bit body, the first blade comprising a first cutter of a scribe shape disposed on the first blade;

a second blade disposed on the bit body, the second blade comprising a second cutter of a round shape disposed on the second blade, wherein a center of the first cutter is disposed at a first radial distance from the surface center of the bit body;

wherein a center of the second cutter is disposed at the first radial distance from the surface center of the bit body; and wherein the first and second cutters are disposed at different locations on the bit body;

wherein the point on the first cutter furthest away from the bit body is at a second radial distance from the surface center of the bit body:

wherein the point on the second cutter furthest away from the bit body is at the second radial distance from the surface center of the bit body, wherein a height of the first cutter perpendicular to a surface of the bit body substantially corresponds to a height of the second cutter perpendicular to the surface of the bit body, so that trajectories of the height of the first cutter and the height of the second cutter 100% overlap each other during rotary motion of the bit.

7. The drill bit of claim 6, wherein the first cutter comprises a pointed tip and the second cutter comprises a surface curvature.

8. The drill bit of claim 6, wherein the first cutter and the second cutter comprise diamond tables fabricated from different diamond materials that have different abrasion and/or impact properties.

9. The drill bit of claim 8, wherein at least 60% the diamond tables of the first cutter and the second cutter overlap when the first cutter and second cutter are rotated to a common radial plane.

10. The drill bit of claim 6, wherein the first blade further comprises one or more cutters having the rounded shape.

11. The drill bit of claim 6, wherein the second blade further comprises one or more cutters having the scribe shape.

12. A drill bit, comprising:

a bit body comprising a surface center;

a first blade disposed on the bit body, the first blade comprising a first cutter of a first shape disposed on the first blade;

a second blade disposed on the bit body, the second blade comprising a second cutter of a second shape disposed on the second blade;

wherein a center of the first cutter is disposed at a first radial distance from the surface center of the bit body;

wherein a center of the second cutter is disposed at the first radial distance from the surface center of the bit body;

wherein the first and second cutters are disposed at different locations on the bit body;

wherein the point on the first cutter furthest away from the bit body is a tip of the first shape that is at a second radial distance from the surface center of the bit body;

wherein the point on the second cutter furthest away from the bit body is a tip of the second shape that is at the second radial distance from the surface center of the bit body, and wherein a horizontal axis of the first shape and a horizontal axis of the second shape have a same width, trajectories of the horizontal axis of the first shape and the horizontal axis of the second shape 100% overlap each other during rotary motion of the bit.

* * * * *